US007597201B2

(12) United States Patent
Brettschneider et al.

(10) Patent No.: US 7,597,201 B2
(45) Date of Patent: Oct. 6, 2009

(54) DEVICE FOR CLEANING FIBROUS SUSPENSIONS FOR PAPER PRODUCTION

(75) Inventors: Werner Brettschneider, Ravensburg (DE); Rainer Meisenberg, Bad Wurzach (DE)

(73) Assignee: Voith Patent GmbH, Heidenheim (DE)

( * ) Notice: Subject to any disclaimer, the term of this patent is extended or adjusted under 35 U.S.C. 154(b) by 339 days.

(21) Appl. No.: 11/671,670

(22) Filed: Feb. 6, 2007

(65) Prior Publication Data

US 2007/0199883 A1 Aug. 30, 2007

(30) Foreign Application Priority Data

Feb. 24, 2006 (DE) ..... 10 2006 008 758

(51) Int. Cl.
*D21D 5/02* (2006.01)
*D21D 5/06* (2006.01)
*B07B 1/18* (2006.01)

(52) U.S. Cl. ..... 210/414; 210/415; 209/250; 209/273; 209/306; 162/55

(58) Field of Classification Search ..... 210/414, 210/415; 209/250, 273, 306; 261/55; 162/55
See application file for complete search history.

(56) References Cited

U.S. PATENT DOCUMENTS 3,029,951 A * 4/1962 Cannon ..... 210/298
3,092,578 A * 6/1963 Cannon et al. ..... 210/304
3,456,793 A * 7/1969 Salomon ..... 209/273
3,545,621 A 12/1970 Lamort
3,933,649 A * 1/1976 Ahlfors ..... 210/378
3,939,065 A * 2/1976 Ahlfors ..... 209/240
4,287,055 A 9/1981 Holz
4,346,007 A 8/1982 Norman et al.

FOREIGN PATENT DOCUMENTS

DE 2908729 9/1979
DE 3023902 1/1982

* cited by examiner

*Primary Examiner*—Thomas M Lithgow
(74) *Attorney, Agent, or Firm*—Greenblum & Bernstein P.L.C.

(57) ABSTRACT

A device for cleaning a suspension, preferably a fibrous suspension for paper production. The device includes a screen basket, on the exterior surface of which the suspension to be cleaned is supplied and from the interior surface of which the screened accepted stock is released. A housing surrounds the screen basket. The housing includes an inflow for the suspension to be cleaned, an accepted-stock outlet for the cleaned suspension and a reject outlet for impurities. A scraping device rotates on the outside of the screen basket about the screen basket axis and has scraper blades (foils) which scrape along the exterior surface of the screen basket. The scraping device comprises a drum with a cylinder surrounding the screen basket. The cylinder carries a plurality of foils on its inside facing the screen basket.

20 Claims, 3 Drawing Sheets

DEVICE FOR CLEANING FIBROUS SUSPENSIONS FOR PAPER PRODUCTION

CROSS-REFERENCE TO RELATED APPLICATIONS

The present application claims priority under 35 U.S.C. §119 of German Patent Application No. 10 2006 008 758.5, filed on Feb. 24, 2006, the disclosure of which is expressly incorporated by reference herein in its entirety.

BACKGROUND OF THE INVENTION

1. Field of the Invention

The invention relates to a device for cleaning suspensions and, in particular, a device for cleaning fibrous suspension for paper production.

2. Discussion of Background Information

A cleaning device comprises a screen basket and a housing enclosed by the screen basket. The housing has an inlet for the suspension to be cleaned, an accepted-stock outlet for the cleaned suspension and a reject outlet for impurities. The device further comprises a scraper device with scraper blades, which closely scrape along the interior or exterior surface of the screen basket.

In an axially perpendicular cross section, the scraper blades can have a wing profile. By using a wing profile, during the rotation of the scraping device, the wings exert a pressure in the direction of the screen basket surface with their front (head) area on the suspension to be cleaned. This forces the accepted-stock portion contained in the suspension through the openings, e.g., slots or bores, of the screen basket. The rear (tail) area, in the direction of rotation, however, is designed to have a suction effect in order to draw out the particles, e.g., generally impurities, stuck in the openings of the screen basket. The scraper blades can also be designed differently, e.g., generally referred to as "foil." Machines of this type are known in multiple variations. Devices of this type are shown in, for example, U.S. Pat. No. 4,287,055 A, DE 30 23 902 A1, U.S. Pat. No. 3,545,621.

Cleaning devices of the type described above are generally constructed in a vertical manner. This means that the screen baskets have a vertical axis and accordingly the rotational axis of the scraping device also runs vertically. But a horizontal construction is also possible.

The flow through the cleaning devices generally occurs according to a centrifugal principle. In this way, the suspension to be cleaned is fed to the interior chamber of the screen basket. The accepted stock then passes outward through the openings of the screen basket, whereas the impurities (rejects) move downward along the interior surface of the screen basket, promoted by the effect of the scraping device, and are discharged at the lower end of the screen basket through a reject outlet. The scraping device is usually located in the interior chamber of the screen basket, and the scraper strips or foils move along the interior surface of the screen basket.

However, there are also centripetal machines. In these types of machines, the suspension to be cleaned is fed to the screen basket from the outside. The accepted stock therefore passes through the openings of the screen basket from the outside inward. The accepted stock is then discharged from the interior of the screen basket, and the rejects are held back at the exterior surface of the screen basket and sink downward. The scraping device can be arranged on the outside of the screen basket, but also on the inside. Devices of this type are shown in, for example, U.S. Pat. No. 3,545,621.

Cleaning or screening machines operated in a centripetal manner have a disadvantage. Specifically, the space between the outside of the screen basket and the housing wall is usually very limited. It is thus difficult to design and arrange the scraping device in such a manner that it still effectively fulfills its function in the limited space. With the exterior arrangement of the scraping device, the scraping device must furthermore be removed before the screen can be removed, which is a disadvantage as screens must be serviced frequently.

A screen device which can be operated in a centripetal manner is known from DE 29 08 729 A1. A so-called cleaning drum is used to keep the screen basket clear. The cleaning drum achieves a pump effect by using centrifugal force, with the aid of radially acting nozzles inserted into the cleaning drum. Material located on the screen surface is to be removed by such centrifugal forces.

SUMMARY OF THE INVENTION

The invention is based on a cleaning device that can achieve a high degree of screening efficiency. The cleaning device of the present invention has a relatively low structural expenditure, with the wear of the elements being low and the scraping effect of the scraping device being high.

The device for cleaning a suspension, preferably a fibrous suspension for paper production comprises a screen basket, on the exterior surface of which the suspension to be cleaned is supplied and from the interior surface of which the screened accepted stock is released. The housing surrounds the screen basket. The housing includes an inflow for the suspension to be cleaned, an accepted-stock outlet for the cleaned suspension and a reject outlet for impurities. A scraping device rotates on the outside of the screen basket about the screen basket axis and has scraper blades (foils) which scrape along the exterior surface of the screen basket. The scraping device comprises a drum with a cylinder surrounding the screen basket. The cylinder is provided with perforations. The cylinder carries a plurality of foils on its inside facing the screen basket.

The screen basket is arranged vertically. The drum rotates about an axis of the screen basket in a direction of rotation. The cylinder is a cage. The foils have a wing profile. A number of the foils per square meter screen basket surface is between 2 and 10. A radial thickness of the drum and the foils is a maximum of about 20% of an exterior diameter of the drum. A radial thickness of the drum and the foils is a maximum of about 10% of an exterior diameter of the drum. The device is for cleaning a fibrous suspension for paper production.

The characteristics of the cleaning device include, amongst other features:

- The suspension to be cleaned flows through the cleaning device in a centripetal manner, i.e., from the outside inward;
- The scraping device is located on the outside of the screen basket; and
- The scraping device comprises a drum surrounding the screen basket, where the drum has a plurality of foil blades on its inside.

These features result in a good utilization of the space available of the cleaning device. The wear of the components involved is low and the contaminants or impurities are broken up to into small portions. The constructional expenditure, and thus the production costs are limited.

The drum has perforations through which the stock to be screened can move in the direction of the screen basket. These perforations can be kept relatively large, as the drum is a space-saving support element for the foil blades.

The drum can be produced and designed in different ways. For example, it is possible to produce the drum as a perforated stainless steel cylinder. The drum can be produced from sheet metal by bending and subsequently be provided with openings, e.g., by laser cutting or water jet cutting. This ensures the roundness of the drum. Afterwards the foil elements can be welded or screwed to the drum. Screw-fastened foil elements can be replaced easily if they are worn or damaged. Both the drum body and the foil elements can optionally also be made of plastic.

The drum can also be designed as a cage. The drum can be constructed, e.g., of circumferential rings and axially parallel rods, where the rings and/or rods carry multifoil elements.

The drum is generally provided with a lid. This lid can be welded or screwed to the jacket of the drum. A connector socket for fastening the rotor to a shaft can advantageously be present in or on the lid.

In further embodiments, the device for cleaning a suspension comprises a screen basket having an exterior surface and an interior surface. A housing surrounds the screen basket. A scraping device rotates on an outside of the screen basket about a screen basket axis. Foils scrape along the exterior surface of the screen basket. A drum surrounding the screen basket is provided with perforations and has a plurality of the foils on its inside, facing the screen basket.

The housing comprises an inflow for suspension to be cleaned, an accepted-stock outlet for cleaned suspension, and a reject outlet for impurities. The drum has a cylinder surrounding the screen basket which includes the perforations and a plurality of the foils. The foils have a wing profile. The number of the foils per square meter screen basket surface is between 2 and 10. The radial thickness of the drum and the foils is a maximum of about 20% of an exterior diameter of the drum. The radial thickness of the drum and the foils is a maximum of about 10% of an exterior diameter of the drum. The perforations are bores or slots distributed over an entire cylinder surface. The drum has a cylinder constructed in a form of a cage from rods running axially or obliquely and from rings running in a helical line such that the perforations are between the rods or rings. The surface of the perforations increases from a bottom upward or vice versa. The dimensions of the perforations are larger than a screen opening.

A method comprises flowing suspension through an annular space formed by a cylinder surrounding a screen basket and a cylindrical housing wall. The cylinder is provided with perforations and has a plurality of the foils on its inside facing the screen basket. The method further comprises passing the suspension through perforations in the cylinder to reach the screen basket. An accepted-stock portion of the suspension passes through the screen basket radially inward so that it enters an annular space and flows to an accepted-stock outlet. Rejects remain outside the screen basket and are discharged from a reject outlet.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
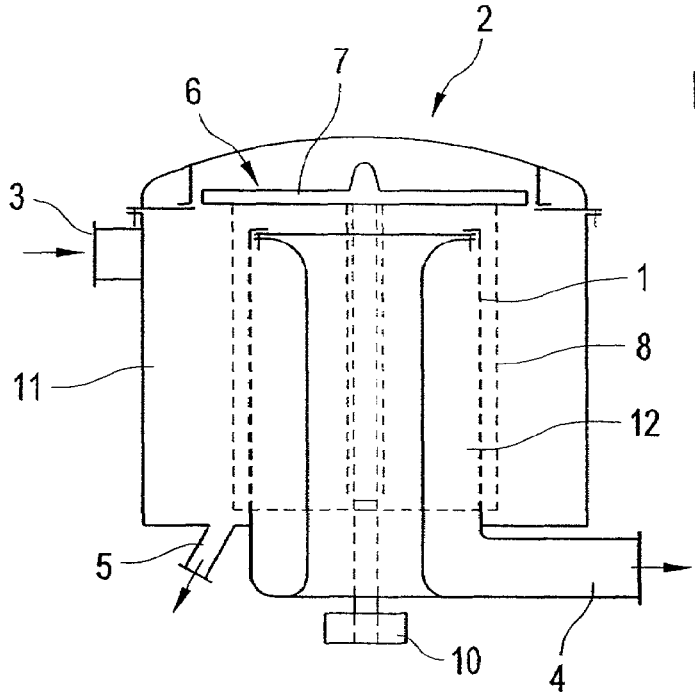
FIG. 1 shows a cleaning device in diagrammatic representation in an axial section.
Figure 2:
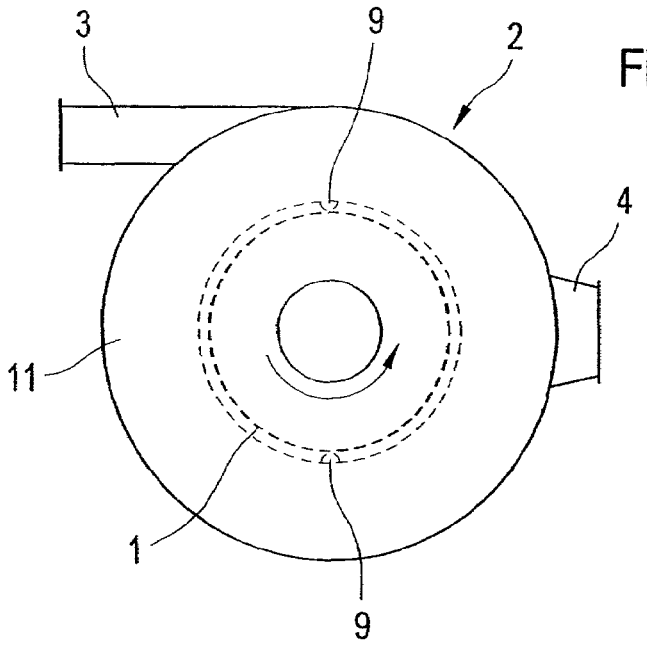
FIG. 2 shows a cleaning device according to FIG. 1, in an axially perpendicular section.

FIGS. 1 and 2 show the cleaning device according to the invention. More particularly, FIG. 1 illustrates the centripetal flow against the screen basket 1. The cleaning device includes a screen basket 1, which is cylindrical. The screen basket 1 is located in a housing 2. The housing 2 has an inflow 3 for the suspension to be cleaned, an outflow 4 for the accepted stock and an outlet 5 for the rejects. The screen basket 1 can be of any design. Generally, the screen basket 1 is made of a precious-metal sheet with round or slot-shaped screen openings.

The screen basket 1 is surrounded by a drum 6. The drum 6 is essentially composed of a lid plate 7 and a cylinder 8. The drum 6 can be put into rotation by a drive 10 connected to the lid plate 7. The cylinder 8 has perforations, e.g., bores or slots, distributed over the entire cylinder surface, so that the throughflow cross sections remaining open are equal. But an uneven distribution is also contemplated by the invention. The cylinder 8 can also be constructed in the form of a cage from rods running axially or obliquely and from rings running in a helical line such that the perforations are between the rods or rings. The surface of the perforations can increase from the bottom upward or vice versa. It is clear that the dimensions of these perforations are considerably larger than the screen opening, as no separation is to be carried out in them.

Figure 3:
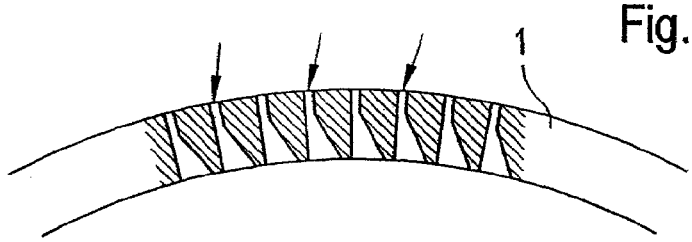
FIG. 3 shows an enlarged representation of a portion of a screen, in an axially perpendicular section.
Figure 4:
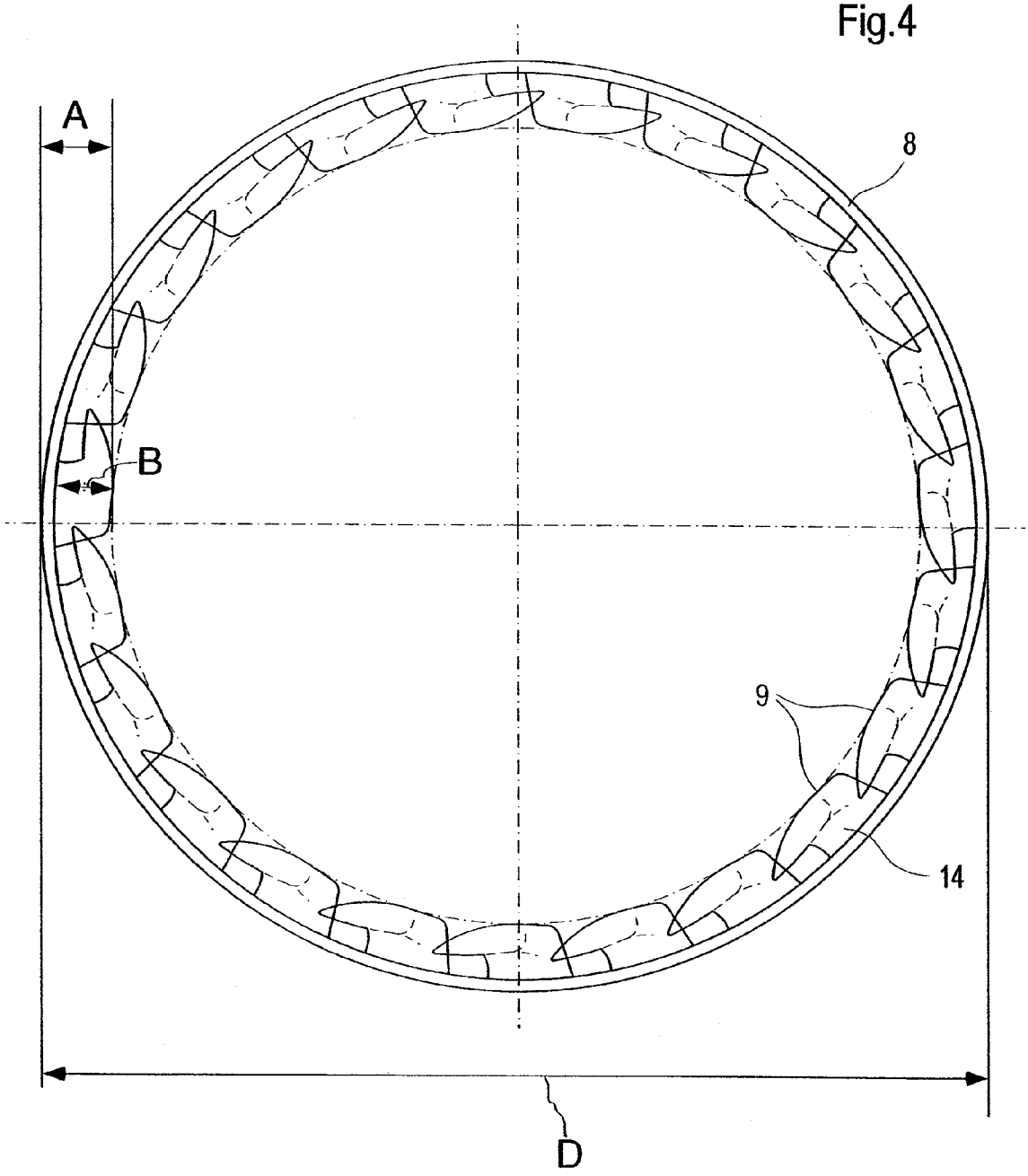
FIG. 4 shows an enlarged representation of a drum with foils, in an axially perpendicular section.
Figure 6:
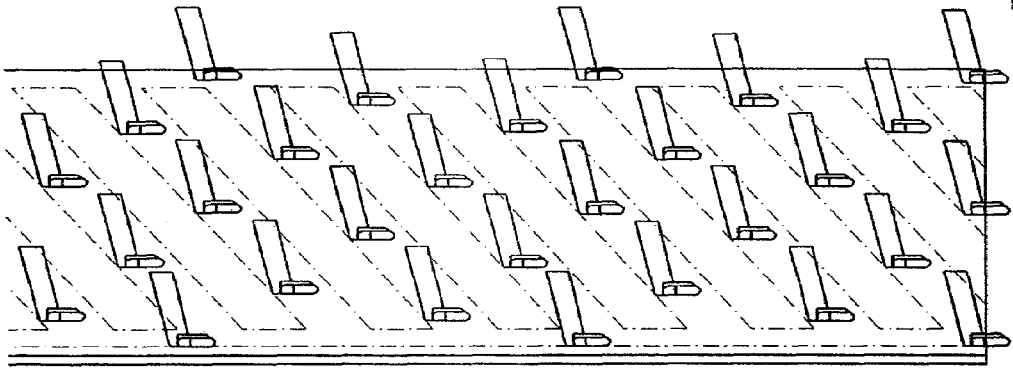
FIG. 6 shows a view to an inside of the drum.
Figure 5:
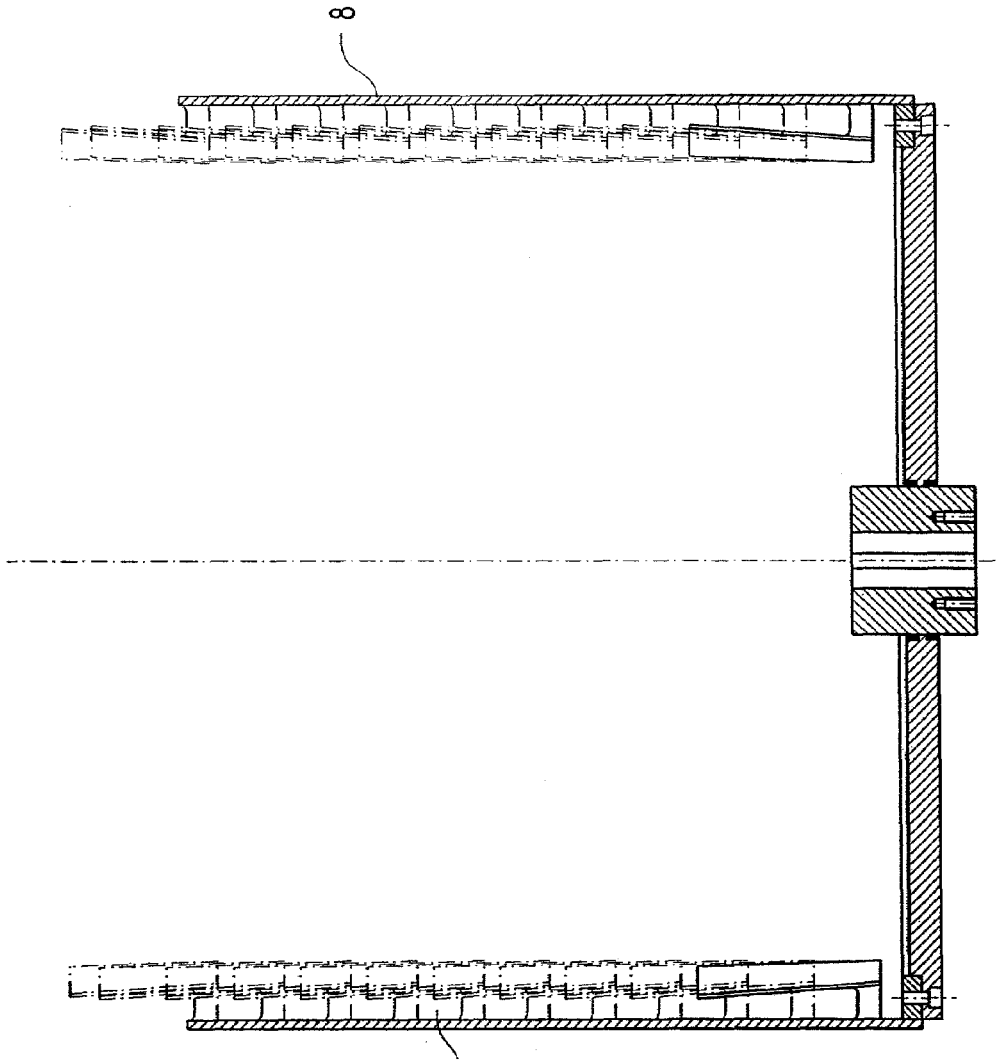
FIG. 5 shows a drum with foils, in an axial section.

FIG. 3 shows an enlarged representation of a portion of a screen, in an axially perpendicular section. FIGS. 4-6 show various views of the drum 6. More particularly, on the inside, the cylinder 8 carries a plurality of foils 9, which can be used for the actual task of keeping the screen clear in an optimum manner. The foils 9 can have a wing profile. The foils 9 are mounted to the cylinder 8 of the drum 6 in a larger number by spacers 13, e.g., screws or welding. The foils 9 can be arranged in a displaced manner, which has the advantage of preventing disturbing pressure pulsations in the stock flows leaving the device, as shown, for example, in FIG. 6. A large number of foils 9 in relation to the square meter of screen basket surface also improves the scraping effect and evens out the strain on the screen basket 1. A value between 2 and 10 foils per square meter of screen surface is contemplated by the invention.

The invention makes it possible to use a scraper at this point even with the limited space in the cleaning device. This applies in particular if the radial thickness A of the drum 6 with the foils 9 is a maximum of about 20%, and more preferably a maximum of about 10%, of the exterior diameter D of the drum 6. The radial thickness A is essentially made up of the wall thickness of the cylinder 8 plus two times the projecting height B of a foil 9.

The flow through the device is centripetal, i.e., the suspension flows from the outside inward seen with respect to the screen basket 1. The suspension first reaches an annular space 11 formed by the cylinder 8 and cylindrical housing wall. The suspension then passes through the perforations in the cylinder 8 of the drum 6 and reaches the screen basket 1. There the accepted-stock portion of the suspension is allowed to pass through the screen basket 1 radially inward, so that it enters an annular space 12 and flows to the accepted-stock outlet 4. The rejects, however, remain outside the screen basket 1 and are discharged from the reject outlet 5.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A device for cleaning a suspension, comprising:

a screen basket, on an exterior surface of which the suspension to be cleaned is supplied and from an interior surface of which the screened accepted stock is released;

a housing surrounding the screen basket, the housing comprising:

an inflow for the suspension to be cleaned, an accepted-stock outlet for the cleaned suspension, and a reject outlet for impurities;

a scraping device which rotates on an outside of the screen basket about a screen basket axis;

foils which scrape along the exterior surface of the screen basket; and a drum having a cylinder surrounding the screen basket, the cylinder being provided with perforations and having a plurality of the foils on its inside facing the screen basket.

2. The device according to claim 1, wherein the screen basket is arranged vertically.

3. The device according to claim 1, wherein the drum rotates about an axis of the screen basket in a direction of rotation.

4. The device according to claim 1, wherein the cylinder is a cage.

5. The device according to claim 1, wherein the foils have a wing profile.

6. The device according to claim 1, wherein a number of the foils per square meter screen basket surface is between 2 and 10.

7. The device according to claim 1, wherein a radial thickness of the drum and the foils is a maximum of about 20% of an exterior diameter of the drum.

8. The device according to claim 1, wherein a radial thickness of the drum and the foils is a maximum of about 10% of an exterior diameter of the drum.

9. The device according to claim 1, wherein the device is for cleaning a fibrous suspension for paper production.

10. A device for cleaning a suspension, comprising:

a screen basket having an exterior surface and an interior surface;

a housing surrounding the screen basket;

a scraping device which rotates on an outside of the screen basket about a screen basket axis;

foils which scrape along the exterior surface of the screen basket; and a drum surrounding the screen basket and provided with perforations and a plurality of the foils on its inside, facing the screen basket.

11. The device according to claim 10, wherein the housing comprises:

an inflow for suspension to be cleaned, an accepted-stock outlet for cleaned suspension, and a reject outlet for impurities.

12. The device according to claim 10, wherein the drum has a cylinder surrounding the screen basket which includes the perforations and the plurality of the foils.

13. The device according to claim 10, wherein the foils have a wing profile.

14. The device according to claim 10, wherein a number of the foils per square meter screen basket surface is between 2 and 10.

15. The device according to claim 10, wherein a radial thickness of the drum and the foils is a maximum of about 20% of an exterior diameter of the drum.

16. The device according to claim 10, wherein a radial thickness of the drum and the foils is a maximum of about 10% of an exterior diameter of the drum.

17. The device according to claim 10, wherein the perforations are bores or slots distributed over an entire cylinder surface.

18. The device according to claim 10, wherein the drum has a cylinder constructed in a form of a cage from rods running axially or obliquely and from rings running in a helical line such that the perforations are between the rods or rings.

19. The device according to claim 18, wherein a surface of the perforations increases from a bottom upward or vice versa.

20. The device according to claim 10, wherein dimensions of the perforations are larger than a screen opening.

* * * * *